US010354624B2

(12) United States Patent
Suenaga et al.

(10) Patent No.: US 10,354,624 B2
(45) Date of Patent: Jul. 16, 2019

(54) WIND INSTRUMENT

(71) Applicant: YAMAHA CORPORATION, Hamamatsu-shi (JP)

(72) Inventors: Yuichiro Suenaga, Hamamatsu (JP); Toru Ohno, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/753,641

(22) PCT Filed: Sep. 13, 2016

(86) PCT No.: PCT/JP2016/076954

§ 371 (c)(1),
(2) Date: Feb. 20, 2018

(87) PCT Pub. No.: WO2017/056964

PCT Pub. Date: Apr. 6, 2017

(65) Prior Publication Data

US 2018/0190245 A1 Jul. 5, 2018

(30) Foreign Application Priority Data

Sep. 30, 2015 (JP) ..... 2015-192842

(51) Int. Cl.
*G10D 7/06* (2006.01)
*G10D 9/00* (2006.01)
(Continued)

(52) U.S. Cl.
CPC ..... *G10D 7/06* (2013.01); *G10D 7/02* (2013.01); *G10D 7/10* (2013.01); *G10D 9/00* (2013.01); *G10D 9/023* (2013.01); *G10D 9/04* (2013.01)

(58) Field of Classification Search
CPC ..... G10D 7/06; G10D 9/00
(Continued)

(56) References Cited

U.S. PATENT DOCUMENTS 968,694 A * 8/1910 Rubright ..... G10D 9/043 84/380 R
1,455,440 A * 5/1923 Hofinger ..... G10D 7/026 29/896.22

(Continued)

FOREIGN PATENT DOCUMENTS

CN 201518217 U 6/2010
GB 1182919 A * 3/1970 ..... G10D 7/023

(Continued)

OTHER PUBLICATIONS

International Search Report issued in International Application No. PCT/JP2016/076954 dated Nov. 29, 2016. English translation provided.

(Continued)

*Primary Examiner* — David S Warren
*Assistant Examiner* — Christina M Schreiber
(74) *Attorney, Agent, or Firm* — Rossi, Kimms & McDowell LLP

(57) ABSTRACT

A wind instrument includes a tube body; a tone hole tube that has an inner open end formed extending from the outer periphery of the tube body and opening to the inside of the tube body, and an outer open end opening to the outside of the tube body; and a finger pressing plate that, in the radial direction of the tone hole tube, extends from the outer open end of the tone hole tube to the outside of the tone hole tube.

8 Claims, 6 Drawing Sheets

(51) Int. Cl.

| | |
|---|---|
| ***G10D 9/04*** | (2006.01) |
| ***G10D 9/02*** | (2006.01) |
| ***G10D 7/02*** | (2006.01) |
| ***G10D 7/10*** | (2006.01) |

(58) Field of Classification Search
USPC ..... 84/380 R
See application file for complete search history.

(56) References Cited

U.S. PATENT DOCUMENTS 1,761,329 A * 6/1930 Charlton ..... G10D 7/06 84/380 R
1,801,690 A * 4/1931 Pruefer ..... G10D 7/005 29/896.22
1,809,380 A * 6/1931 Gulick ..... G10D 7/00 84/382
3,062,084 A 11/1962 Ogilvie
3,487,742 A * 1/1970 Mills ..... G10D 7/00 84/384
D218,545 S * 8/1970 Frost ..... 84/380 R
3,722,348 A * 3/1973 Visser ..... G10D 7/023 84/380 C
3,805,665 A * 4/1974 Oouchi ..... G10D 7/023 84/380 C
3,866,507 A * 2/1975 Eajardo ..... G10D 9/02 84/384
4,306,484 A * 12/1981 Toyama ..... G10D 7/005 84/380 C
4,798,122 A * 1/1989 Gisler ..... G10D 9/043 264/242
4,998,456 A * 3/1991 Kahonen ..... G10D 7/005 84/384
5,309,806 A * 5/1994 Stavash ..... G10D 7/02 84/380 R
D360,904 S * 8/1995 Schilling ..... D17/10
6,078,002 A * 6/2000 Kenmochi ..... G10D 7/063 84/380 R
6,852,917 B2 * 2/2005 McAleenan ..... G10D 7/005 84/380 R
9,959,848 B2 * 5/2018 Yonezu ..... G10D 7/04
2003/0070530 A1 * 4/2003 McAleenan ..... G10B 3/08 84/380 R
2004/0111865 A1 * 6/2004 Craig ..... B29C 33/485 29/527.3
2008/0028914 A1 * 2/2008 Straubinger ..... G10D 9/043 84/385 P
2009/0320667 A1 * 12/2009 Rei Ner ..... G10D 9/043 84/380 R
2011/0219936 A1 * 9/2011 Masuda ..... G10D 7/00 84/330
2012/0011987 A1 * 1/2012 Braun ..... G10D 7/026 84/384
2012/0048094 A1 3/2012 Gisler et al.
2013/0145920 A1 6/2013 Takegami
2015/0221289 A1 * 8/2015 Brockman ..... G10D 9/043 84/386
2017/0243570 A1 * 8/2017 Clissold ..... G10D 7/02
2018/0190245 A1 * 7/2018 Suenaga ..... G10D 7/06
2018/0254026 A1 * 9/2018 Suenaga ..... G10D 7/02

FOREIGN PATENT DOCUMENTS

GB 1182919 A * 3/1970 ..... G10D 7/023
JP 50137025 U 11/1975
JP 52055233 U 4/1977
JP 55033178 A * 3/1980
JP 55033178 A * 3/1980
JP S55033178 A 3/1980
JP 02107198 U 8/1990
JP 05083796 U 11/1993
JP H10171445 A 6/1998
JP 2011186443 A 9/2011
JP 2012063467 A 3/2012
JP 2013213952 A * 10/2013
JP 2013213952 A * 10/2013
JP 2014016407 A 1/2014
JP 2015043068 A 3/2015
KR 1020080104949 A 12/2008

OTHER PUBLICATIONS

Written Opinion issued in International Application No. PCT/JP2016/076954 dated Nov. 29, 2016.
International Search Report issued in Intl. Appln. No. PCT/JP2016/077660 dated Dec. 6, 2016. English translation provided.
Written Opinion issued in Intl. Appln. No. PCT/JP2016/077660 dated Dec. 6, 2016.
Yamaha Corporation. "Recorders" Dec. 2014.
Copending U.S. Appl. No. 15/754,369, filed Feb. 22, 2018. (a copy is not included because the cited application is not yet available to the public and the Examiner has ready access to the cited application).
Extended European Search Report issued in European Appln. No. 16851138.4 dated May 8, 2019.
Extended European Search Report issued in European Appln. No. 16851262.2 dated May 8, 2019.

* cited by examiner

WIND INSTRUMENT

TECHNICAL FIELD

The present invention relates to a wind instrument.

Priority is claimed on Japanese Patent Application No. 2015-192842, filed Sep. 30, 2015, the content of which is incorporated herein by reference.

BACKGROUND ART

Conventionally, there is a wind instrument in which a plurality of tone holes are formed that penetrate the tube wall thereof. In order to suitably set the pitch and sound quality of the wind instrument, ensuring the lengths of the tone holes (axial lengths) is performed. Patent Document 1 discloses a wind instrument in which the penetration direction of the tone holes is inclined with respect to the axial line of the tube body so that the pitch and sound quality are favorably obtained.

PRIOR ART DOCUMENTS

Patent Documents

[Patent Document 1] Japanese Unexamined Patent Application, Publication No. H10-171445

SUMMARY OF THE INVENTION

Problems to be Solved by the Invention

However, in a conventional wind instrument, since the tone holes are formed penetrating the tube wall of the tube body, in order to ensure the lengths of the tone holes, the thickness of the tube wall is increased. For this reason, problems arise such as many resources (for example, wood material and resin material) becoming necessary for constituting the wind instrument, and the weight of the wind instrument increasing.

The present invention was achieved in view of the aforementioned circumstances, and has as its object to provide a wind instrument that can achieve economization of resources and a reduction in weight while ensuring the lengths of the tone holes.

Means for Solving the Problems

The wind instrument of one aspect of the present invention is provided with a tube body; a tone hole tube that has an inner open end formed extending from the outer periphery of the tube body and opening to the inside of the tube body, and an outer open end opening to the outside of the tube body; and a finger pressing plate that, in the radial direction of the tone hole tube, extends from the outer open end of the tone hole tube to the outside of the tone hole tube.

The wind instrument of another aspect of the present invention is provided with a tube body that has a first through hole constituting a tone hole; and a finger pressing plate that is disposed on the outer periphery of the tube body and that has a second through hole that constitutes the first through hole and the tone hole, in which the tube body is constituted by a pair of separate structures that are separated so as to divide the tone hole, and the finger pressing plate is disposed on the outer periphery of the tube body so as to cover the boundary of the pair of separate structures.

EFFECTS OF THE INVENTION

According to the present invention, it is possible to achieve economization of resources and a reduction in weight while ensuring the lengths of the tone holes in the wind instrument. Also, it is possible to secure the operability of the wind instrument by the performer.

EMBODIMENTS FOR CARRYING OUT THE INVENTION

First Embodiment

Hereinbelow, the first embodiment of the present invention will be described with reference to FIG. 1, FIG. 2, FIG. 3A and FIG. 3B.

Figure 1:
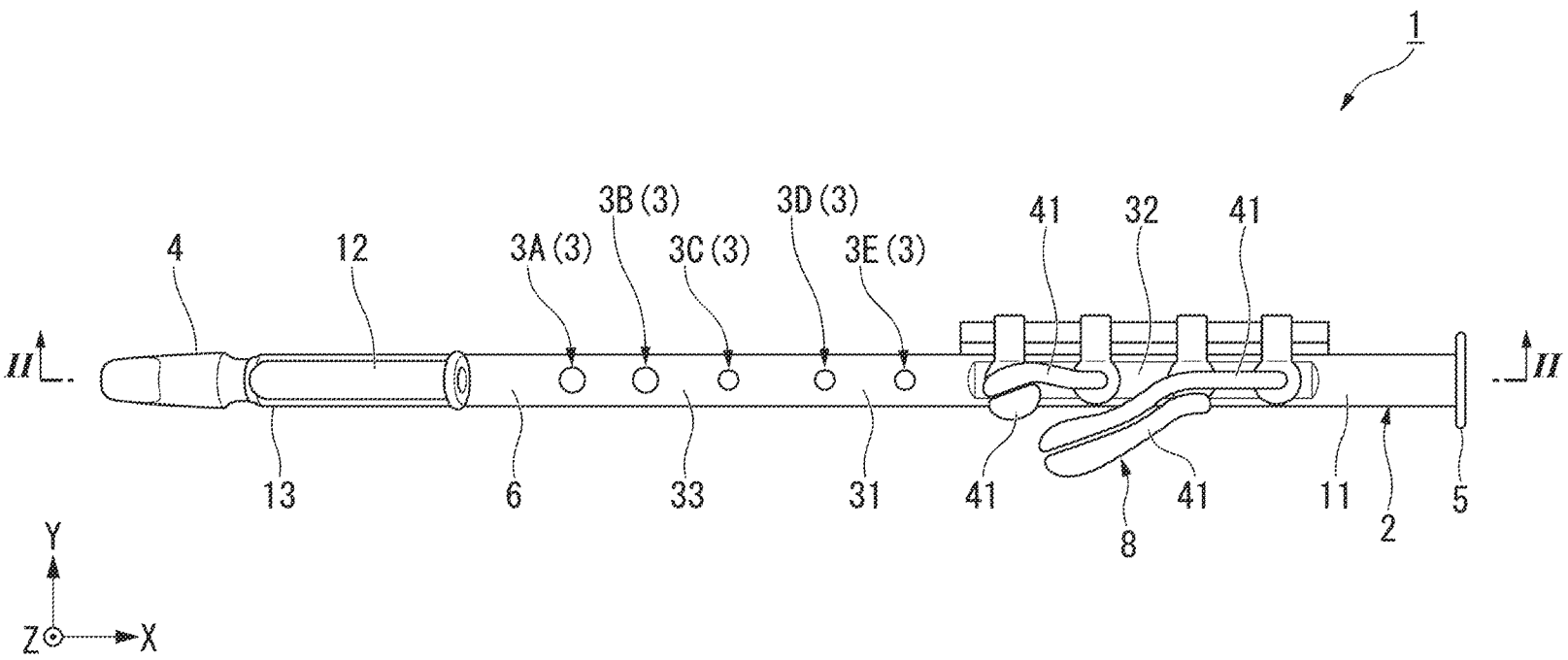
FIG. 1 is a front view showing the wind instrument according to the first embodiment of the present invention.
Figure 2:
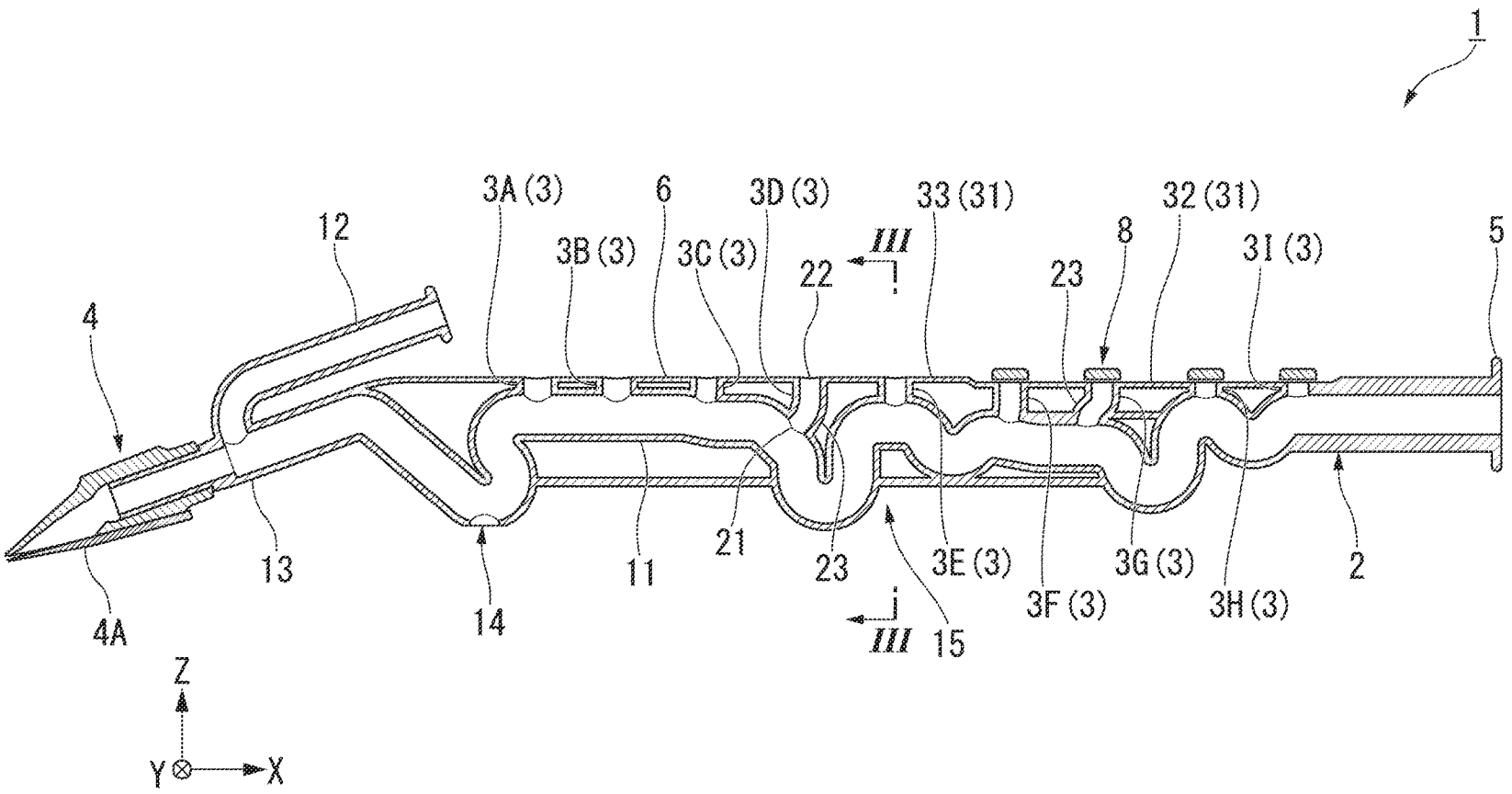
FIG. 2 is a cross-sectional view along arrows II-II of FIG. 1.

As shown in FIGS. 1 and 2, a wind instrument 1 of the present embodiment is provided with a tube body 2, a tone hole tube 3, a mouthpiece 4 (blow hole), a bell 5, and a finger pressing plate 6. The mouthpiece 4 and the bell 5 are disposed at both ends of the tube body 2 in the lengthwise direction (X-axis direction). The mouthpiece 4, which may for example be integrally formed with the tube body 2, in this embodiment is detachably mounted on the tube body 2. The mouthpiece 4, which may be a single reed provided with one sheet-like reed 4A as in the illustrated example, may also for example be an air reed, a lip reed, or a double reed.

In the present embodiment, the lengthwise direction of the tube body 2 and the like corresponds to the straight direction, viewed from a performer playing the wind instrument 1, from the mouthpiece 4 to the bell 5. In the description that follows, the horizontal direction viewed from the performer is called the width direction (Y-axis direction) of the tube body 2 and the like, and the vertical direction viewed from the performer is called the height direction (Z-axis direction) of the tube body 2 and the like.

The tube body 2 may be formed by any one material of for example a wood material, a metal material, and a resin material, and may be formed by for example a material that suitably combines these materials.

The tube body 2 of the present embodiment is provided with a main tube 11, in which at both ends in the lengthwise direction the mouthpiece 4 and the bell 5 are arranged, and an auxiliary tube 12 that is connected to the main tube 11 so as to branch off from the main tube 11.

The main tube 11 and the auxiliary tube 12 are formed in a cylindrical shape with the inner diameter dimension of each being fixed. The auxiliary tube 12 is connected to the end portion on the mouthpiece 4 side of the main tube 11 (first end portion 13). In the present embodiment, the auxiliary tube 12 is disposed at a region on the upper side (the upper side in the Z-axis direction) of the main tube 11, and extends in the height direction and lengthwise direction with respect to the main tube 11. That is, the auxiliary tube 12 does not extend in the width direction with respect to the main tube 11. In the illustrated example, the auxiliary tube 12 extends so as to follow the axial line A1 of the main tube 11 (refer to FIG. 3A), but is not limited thereto.

As a result of the tube body 2 being provided with the main tube 11 and the auxiliary tube 12, the wind instrument 1 of the present embodiment has the same acoustic characteristics as the case of the tube body 2 being conical.

The tone hole tube 3 constitutes the tone hole of the wind instrument 1 of the present embodiment, and is formed extending from the outer periphery of the main tube 11. The tone hole tube 3 has an inner open end 21 that opens to the inside of the main tube 11, and an outer open end 22 that opens to the outside of the main tube 11. The tone hole tube 3 is formed in a cylindrical shape with the inner diameter being fixed.

A plurality of the tone hole tubes 3 are arrayed spaced apart in the axial direction of the main tube 11.

The position of the inner open end 21 of each tone hole tube 3 in the axial direction of the main tube 11 (position in the axial direction) is set in consideration of the pitch of the wind instrument 1. The inner diameter and axial length of each tone hole tube 3 are individually set in consideration of the pitch and sound production (for example, volume, timbre and the like) of the wind instrument 1. That is, the inner diameter and axial length of the tone hole tubes 3 mutually differ for the plurality of tone hole tubes 3.

In addition, the inner diameter of some of the tone hole tubes 3 (3A to 3E) is set to a size that allows the outer open ends 22 of the tone hole tubes 3 to be blocked by the fingers of the performer.

In the present embodiment, the plurality of tone hole tubes 3 are arranged in a row in the lengthwise direction of the main tube 11. More specifically, the inner open ends 21 of the plurality of tone hole tubes 3 are disposed at the same position mutually in the circumferential direction of the main tube 11. Also, the width direction of the main tube 11 is not included in the direction in which the plurality of tone hole tubes 3 extend from the tube body 2. In the present embodiment, the plurality of tone hole tubes 3 are all disposed at positions on the upper side of the main tube 11.

In addition, the plurality of tone hole tubes 3 each have a region that extends in the height direction of the main tube 11 with respect to the main tube 11. Some tone hole tubes 3 (3A to 3C, 3E, 3F, 3H, 3I) all extend straight in the height direction of the main tube 11. The remaining tone hole tubes 3 (3D, 3G), although curved as described below, have regions that extend in the height direction of the main tube 11.

These tone hole tubes 3 constitute tone holes for pitch operation (pitch tone holes) in which, by being opened and closed, the pitch of the wind instrument 1 changes.

In the present embodiment, the number of the aforementioned tone hole tubes 3 is nine, and it would be difficult to directly open and close all the tone hole tubes 3 with the performer's fingers. For that reason, the wind instrument 1 of the present embodiment is provided with a key mechanism 8 (key system).

The first to fifth tone hole tubes 3A to 3E of the nine tone hole tubes 3, counting from the first end portion 13 side of the main tube 11, are directly opened by the fingers of the performer. The first to third tone hole tubes 3A to 3C respectively correspond to the index finger, middle finger, and ring finger of the performer's left hand, while the forth and fifth tone hole tubes 3D and 3E respectively correspond to the index finger and middle finger of the right hand.

The sixth to ninth tone hole tubes 3F to 3I are opened and closed by utilizing the key mechanism 8 (key system). The key mechanism 8 is operated by the ring finger and little finger of the performer's right hand.

A tone hole 14 that is opened and closed by the thumb (left hand thumb) of the performer is also formed in the main tube 11. The thumbhole 14 is formed in the main tube 11 at a region more to the mouthpiece 4 side than the tone hole tubes 3 in the axial direction of the main tube 11. The thumbhole 14 of the present embodiment opens to the lower side of the main tube 11 (negative direction side in the Z axis). The thumbhole 14 changes the pitch of the wind instrument 1 by being opened and closed similarly to the tone hole tubes 3 described above.

In the wind instrument 1 of the present embodiment, the main tube 11 and some tone hole tubes 3 (3D and 3G) are curved so that the plurality of outer open ends 22 are at positions corresponding to the fingers that block the outer open ends 22. Hereinbelow, this point will be described in detail.

The main tube 11 of the present embodiment meanders by being bent a plurality of times. The meandering direction of the main tube 11 may for example be the width direction of the main tube 11, but in the present invention is the height direction of the main tube 11. That is, the main tube 11 of the present embodiment does not meander in the width direction. By the meandering of the main tube 11, the length (linear length) of the main tube 11 in the lengthwise direction of the main tube 11 is shorter than the length of the main tube 11 in the axial direction of the main tube 11 (axial length).

In addition, by the curving of the main tube 11, the interval of mutually adjacent tone hole tubes 3 in the lengthwise direction of the main tube 11 is smaller than the interval of the tone hole tubes 3 in the axial direction of the main tube 11. For example, by the curving of the region of the main tube 11 positioned between the fourth tone hole tube 3D and the fifth tone hole tube 3E, the interval of the fourth tone hole tube 3D and the fifth tone hole tube 3E in the lengthwise direction of the main tube 11 is smaller than the interval of the fourth tone hole tube 3D and the fifth tone hole tube 3E in the axial direction of the main tube 11.

By the curving of the main tube 11, the interval of the first tone hole tube 3A, which is opened and closed by the left hand index finger, and the thumbhole 14, which is opened and closed by the left hand thumb, in the lengthwise direction of the main tube 11 is less than the interval of the first tone hole 3A and the thumbhole 14 in the axial direction of the main tube 11.

In the present embodiment, the main tube 11 meanders in the height direction. For this reason, there are regions positioned relatively high and regions positioned relatively low in the main tube 11.

The tone hole tubes 3 whose axial lengths are comparatively short (3A to 3C, 3E, 3F, 3H, 3I) are disposed at regions of the main tube 11 that are positioned relatively high. On the other hand, the tone hole tubes 3 whose axial lengths are comparatively long (3D, 3G) are disposed at regions of the main tube 11 that are positioned relatively low. Thereby, the outer open ends 22 of the plurality of tone hole tubes 3 are positioned in close proximity to each other in the height direction of the main tube 11, compared to the case of the main tube 11 not meandering. In the present embodiment, by combining with the curving of the tone hole tubes 3 described below, the outer open ends 22 of the plurality of tone hole tubes 3 are positioned at the same height (same plane).

Also, in the present embodiment, by the meandering of the main tube 11 in the height direction, a depression portion 15 is formed at a region on the lower side (Z-axis negative direction side) of the main tube 11. The depression portion 15 is disposed near the fourth and fifth tone hole tubes 3D and 3E that are opened and closed by the index and middle fingers of the right hand in the lengthwise direction of the main tube 11. The depression portion 15 may be positioned on the lower side of the fifth tone hole tube 3E as illustrated in FIG. 2, and may for example be positioned between the fourth and fifth tone hole tubes 3D and 3E in the lengthwise direction of the main tube 11.

It is possible to arrange the right hand thumb of the performer at the depression portion 15.

In the wind instrument 1 of the present embodiment, the tone hole tubes 3 (3D and 3G) that are set to have a long axial length compared with the other tone hole tubes 3 (3A to 3C, 3E, 3F, 3H, 3I) are curved. That is, the tone hole tubes 3 with a comparatively short axial length (3A to 3C, 3E, 3F, 3H, 3I) extend straight from the main tube 11 in the height direction (the radial direction of the main tube 11). Also, the tone hole tubes 3 with a comparatively long axial length (3D and 3G) extend in the height direction (radial direction of the main tube 11) while curving from the main tube 11.

In the present embodiment, the curving tone hole tubes 3D and 3G have a curved tube portion 23 that changes the direction of the axial line of the tone hole tubes 3D and 3G midway in the axial direction of the tone hole tubes 3D and 3G. The curved tube portion 23 may constitute a portion of the tone hole tubes 3D and 3G as illustrated in FIG. 2, and for example may constitute the entirety of the tone hole tubes 3D and 3G.

Although the direction of curving of the tone hole tubes 3D and 3G may for example be the width direction of the main tube 11, in the present embodiment the direction is the lengthwise direction of the main tube 11. That is, the tone hole tubes 3D and 3G of the present embodiment are not curved in the width direction of the main tube 11.

In the present embodiment, by the curving of the tone hole tubes 3 with a comparatively long axial length (3D and 3G), the position and direction of each outer open end 22 of the plurality of tone hole tubes 3 is favorably set in consideration of the operability of the wind instrument 1.

For example, by the curving of the fourth tone hole tube 3D that is blocked by the index finger of the right hand, the outer open end 22 of the fourth tone hole tube 3D and the outer open end 22 of the fifth tone hole tube 3E that is blocked by the middle finger of the right hand are positioned in mutual proximity in the lengthwise direction and height direction of the main tube 11. That is, by the bending of the tone hole tube 3D, the outer open ends 22 of the plurality of tone hole tubes 3D and 3E that are blocked by fingers of the same hand are positioned in mutual proximity.

The direction of the inner open end 21 of the fourth tone hole tube 3D differs from the inner open ends 21 of the other tone hole tubes 3 (3A, 3B, 3C, 3E and the like) and is inclined in the lengthwise direction with respect to the upper side in the height direction of the main tube 11. However, by the curving of the fourth tone hole tube 3D, the direction of the outer open end 22 of the fourth tone hole tube 3D becomes the upper side in the height direction of the main tube 11, similarly to the outer open ends 22 of the other tone hole tubes 3. While the fourth tone hole tube 3D may for example be curved a plurality of times, in the present embodiment the fourth tone hole tube 3D is curved only once.

By the curving of the seventh tone hole tube 3G that is opened and closed by using the key mechanism 8, the intervals between the outer open end 22 of the seventh tone hole tube 3G and the outer open ends 22 of the sixth and eighth tone hole tubes 3F and 3H are adjusted in consideration of the configuration of the key mechanism. In the present embodiment, the seventh tone hole tube 3D meanders by being curved a plurality of times.

Also, in the present embodiment, by the curving of the main tube 11 and the tone hole tubes 3, the positions of the outer open ends 22 of the plurality of tone hole tubes 3 in the height direction of the main tube 11 mutually align. In the illustrated example, although the positions in the height direction of the main tube 11 mutually differ between the outer open ends 22 of the tone hole tubes 3A to 3E that are directly opened and closed by fingers and the outer open ends 22 of the tone hole tubes 3F to 3I that are opened and closed by using the key mechanism 8, the positions may for example align.

As shown in FIG. 1, FIG. 2, FIG. 3A and FIG. 3B, the finger pressing plate 6 extends in the radial direction of the tone hole tube 3 from the outer open end 22 of the tone hole tube 3 to the outside of the tone hole tube 3. That is, the finger pressing plate 6 is a flange that is formed at the outer open end 22 of the tone hole tube 3. The finger pressing plate 6 is disposed spaced apart with respect to the outer periphery of the main tube 11. In the present embodiment, the outer open end 22 of the tone hole tube 3 faces the upper side of the main tube 11. For this reason, the extending direction of the finger pressing plate 6 is the lengthwise direction and the width direction of the main tube 11, which are perpendicular to the height direction of the main tube 11.

In the present embodiment, a common finger pressing plate 6 is provided for the plurality of tone hole tubes 3. That is, the same finger pressing plate 6 is provided for the plurality of tone hole tubes 3.

In the present embodiment, since the outer open ends 22 of the plurality of tone hole tubes 3 are arrayed in the lengthwise direction, the finger pressing plate 6 is formed in a band plate shape extending in the lengthwise direction of the main tube 11. Also, in the present embodiment, the dimension of the finger pressing plate 6 in the width direction of the main tube 11 (width dimension) is set so as not to protrude from both ends in the width direction of the main tube 11, in consideration of the operability by the performer.

The finger pressing plate 6 should be provided for at least the tone hole tubes 3A to 3E that are directly opened and closed by the fingers, but as shown in FIG. 2, in the present embodiment the finger pressing plate 6 is also provided for the tone hole tubes 3F to 3I that are opened and closed by using the key mechanism 8.

The finger pressing plate 6 has the surface to which the outer open end 22 of the tone hole tube 3 opens (opening surface 31).

Figure 3A:
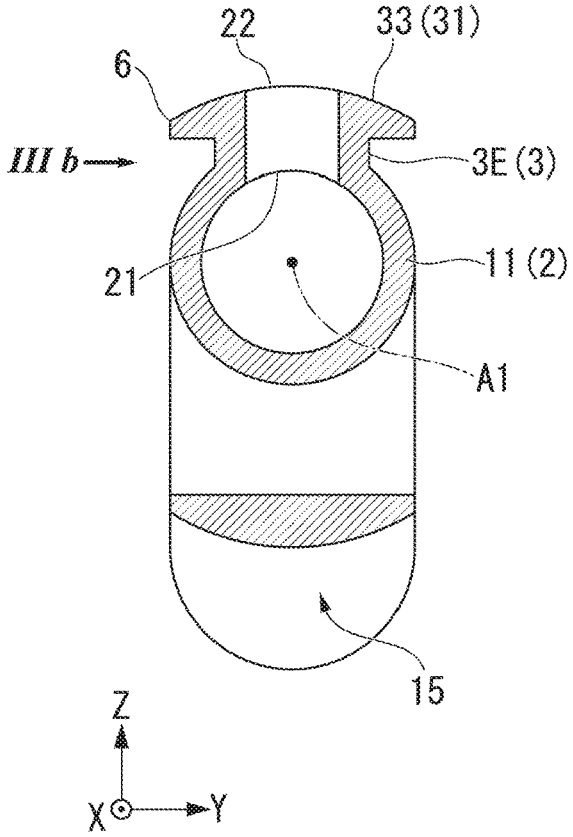
FIG. 3A is a cross-sectional view along arrows III-III of FIG. 2.

Among the opening surface 31 of the finger pressing plate 6, the region where the outer open ends 22 of the tone hole tubes 3 opened and closed by the key mechanism 8 are disposed (hereinbelow called the key opening surface 32) is formed to be a planar surface. On the other hand, among the opening surface 31 of the finger pressing plate 6, the region where the outer open ends 22 of the tone hole tubes 3 directly opened and closed by fingers are disposed (hereinbelow called the finger opening surface 33) is formed to be a curved surface, as shown in FIG. 3A.

Figure 3B:
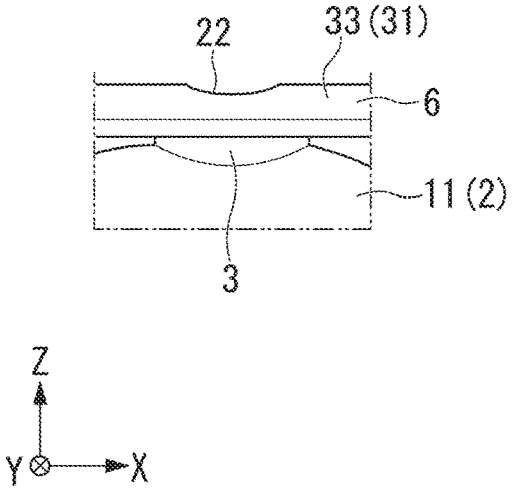
FIG. 3B is a view in the direction of arrow IIIb of FIG. 3A.

In the present embodiment, the finger opening surface 33 curves in a convex shape when viewed from the lengthwise direction of the main tube 11 (refer to FIG. 3A), and is formed to be a curved surface that does not curve when viewed from the width direction of the main tube 11 (refer to FIG. 3B). Thereby, as shown in FIG. 3B, a dent shape in which a finger enters is formed at the outer open end 22 of the tone hole tube 3.

As described above, according to the wind instrument 1 of the present embodiment, by the tone hole being constituted by the tone hole tube 3, it is possible to set the thickness of the tube wall of the tube body 2 without consideration to the length of the tone hole. Thereby, it is possible to thinly form the tube wall of the tube body 2. Accordingly, it is possible to economize resources for constituting the wind instrument 1 and it is possible to achieve a reduction in weight of the wind instrument 1.

Since the wind instrument 1 of the present embodiment is provided with the finger pressing plate 6, the performer can easily judge by the sense of touch of a finger whether the outer open end 22 of the tone hole tube 3 is correctly blocked by the finger. Hereinbelow, this point is explained in detail.

In the case of no finger pressing plate 6, when the performer blocks the outer open end 22 of the tone hole tube 3 with his own finger, the finger of the performer may touch not only the inner edge of the outer open end 22 but also the outer edge, with these feelings all being transmitted to the finger of the performer. For this reason, it is difficult for the performer to judge whether the outer open end 22 of the tone hole tube 3 is correctly blocked.

In contrast to this, in the case of the finger pressing plate 6 being present, when blocking the outer open end 22 of the tone hole tube 3 with a finger, the finger makes no contact with the outer edge of the outer open end 22. Thereby, the performer easily ascertains the inner edge of the outer open end 22 of the tone hole tube 3 by the feeling of the finger. That is, the performer can easily judge by the feeling of the finger whether the outer open end 22 of the tone hole tube 3 is correctly blocked by the finger.

In addition, in the wind instrument 1 of the present embodiment equipped with the finger pressing plate 6, when a finger of the performer is not blocking the outer open end 22 of the tone hole tube 3, it is also possible to place the finger on the opening surface 31 of the finger pressing plate 6 (in particular, the finger opening surface 33). For this reason, the performer can easily move his fingers from a position that does not block the outer open ends 22 of the tone hole tubes 3 to a position that does block the outer open ends 22 of the tone hole tubes 3.

Also, since the wind instrument 1 of the present embodiment is provided with the finger pressing plate 6, the performer can easily perform the operation that blocks the outer open ends 22 of the tone hole tubes 3 with his own fingers. Hereinbelow, this point is described in detail.

In the case of no finger pressing plate 6, in the event of the performer attempting to block the outer open end 22 of the tone hole tube 3 with his own finger, when the finger of the performer becomes separated from the outer open end 22 of the tone hole tube 3, the finger becomes positioned on the outer periphery of the tone hole tube 3. In this case, it is necessary to lift the finger from the outer periphery of the tone hole tube 3 and move the finger to the position blocking the outer open end 22 of the tone hole tube 3, and so the operability of the wind instrument 1 is not necessarily favorable.

In contrast to this, in the case of the finger pressing plate 6 being present, even if a finger of the performer becomes separated from the outer open end 22 of the tone hole tube 3, since the finger abuts the finger opening surface 33 of the finger pressing plate 6, the finger need only be moved along the finger opening surface 33 to the outer open end 22. That is, since the need to lift the finger is eliminated, even if the finger of the performer becomes separated from the outer open end 22 of the tone hole tube 3, the performer can easily perform the operation of blocking the outer open end 22 of the tone hole tube 3 with his own finger.

From the above, according to the wind instrument 1 of the present embodiment, it is possible to ensure the operability of the wind instrument 1 by the performer with the presence of the finger pressing plate 6.

Also, according to the wind instrument 1 of the present embodiment, the same finger pressing plate 6 is provided for the plurality of tone hole tubes 3. For this reason, the edge portion at the distal end in the extending direction of the finger pressing plate 6 (the region corresponding to the edge of the finger opening surface 33) is not located between the outer open ends 22 of adjacent tone hole tubes 3. For this reason, it is possible to lower the possibility of a finger of the performer touching the edge portion at the distal end in the extending direction of the finger pressing plate 6. Thereby, the performer can further easily ascertain whether the outer open end 22 of the tone hole tube 3 is correctly blocked by a finger with the feeling of the finger.

Also, according to the wind instrument 1 of the present embodiment, the gap between adjacent tone hole tubes 3 is covered by the finger pressing plate 6. For that reason, when the performer tries to block the outer open end 22 of the tone hole tube 3 with that finger, even if the performer's finger becomes separated from the outer open end 22 of the tone hole tube 3, it is possible to prevent the performer's finger from entering between adjacent tone hole tubes 3. Thereby, even if the performer's finger is separated from the outer open end 22 of the tone hole tube 3, the need to lift the finger is eliminated, and the performer can easily perform the operation of blocking the outer open end 22 of the tone hole tube 3 with his own finger.

From the above, by the same finger pressing plate 6 being provided for the plurality of tone hole tubes 3, it is possible to more favorably ensure the operability of the wind instrument 1 by the performer.

By the same finger pressing plate 6 being provided for the plurality of tone hole tubes 3, in the case of fabricating the tube body 2 of the wind instrument 1, the tone hole tubes 3 and the finger pressing plate 6 by resin molding, compared to the case of the finger pressing plate 6 being provided for each tone hole tube 6, it is possible to achieve a simplification of the mold shape. Thereby, it is possible to easily manufacture the wind instrument 1. Also, it is possible to achieve a reduction in the manufacturing cost of the wind instrument 1.

According to the wind instrument 1 of the present embodiment, since the finger opening surface 33 of the finger pressing plate 6 is formed into a curved surface, the performer can correctly and easily block the outer open end 22 of the tone hole tube 3 with a finger. Specifically, by the finger opening surface 33 of the finger pressing plate 6 being formed into a curved surface, a dent shape in which the finger enters is formed at the outer open end 22 of the tone hole tube 3. For this reason, the performer can correctly and easily block the outer open end 22 of the tone hole tube 3 by causing the finger to enter the outer open end 22 made to have a dent shape.

According to the wind instrument 1 of the present embodiment, it is possible to easily secure both the acoustic performance of the wind instrument 1 and the operability of the wind instrument 1. Hereinbelow, this point is described in detail.

When designing the wind instrument 1, the pitch and sound production (for example, volume, timbre and the like) are adjusted, and the arrangement of the plurality of tone holes in the main tube 11 is adjusted in consideration of the operability of the wind instrument 1. In the wind instrument 1 of the present embodiment, it is possible to adjust the pitch of the wind instrument 1 by changing the position (axial position) of the inner open end 21 of the tone hole tube 3 with respect to the main tube 11 and the axial length of the tone hole tube 3 (length dimension of the tone hole). It is possible to suitably adjust the arrangement of the outer open ends 22 of the plurality of tone hole tubes 3 considering the operability of the wind instrument 1 so as not to interfere with the pitch adjustment, due to the main tube 11 and the tone hole tubes 3 being bent. Moreover, with regard to sound production of the wind instrument 1, since the need to use the diameter dimension of the tone holes as the main adjustment of the pitch described above is eliminated, it is possible to effectively utilize the inner diameter dimension of the tone hole tube 3 (diameter dimension of the tone hole).

Further describing these points, although it is possible to adjust the pitch of the wind instrument 1 by changing the internal diameter dimension of the tone hole tubes 3, in the present embodiment it is possible to freely change the length dimension of the tone hole tubes 3 without impairing the operability of the wind instrument 1. For this reason, in the wind instrument 1 of the present embodiment, it is possible to sufficiently adjust the pitch of the wind instrument 1 by changing the length dimension of the tone hole tube 3 instead of changing the inner diameter dimension of the tone hole tube 3. On the other hand, although the sound production of the wind instrument 1 is adjusted by changing the internal diameter dimension of the tone hole tubes 3, in the wind instrument 1 of the present embodiment, since it is not required to use changes of the internal diameter dimension of the tone hole tubes 3 for pitch adjustment, it is possible to suppress the influence of pitch adjustment on adjustment of sound production.

That is, according to the wind instrument 1 of the present embodiment, it is possible to relax restrictions on pitch adjustment, sound production adjustment, and adjustment of the tone hole arrangement in consideration of operability. Accordingly, it is possible to easily ensure both the acoustic performance of the wind instrument 1 and the operability of the wind instrument 1.

Also, according to the wind instrument 1 of the present embodiment, the plurality of tone hole tubes 3 each have a region that extends in the height direction of the main tube 11 with respect to the main tube 11, and the meandering direction of the main tube 11 is parallel with the height direction of the main tube 11.

For this reason, it is possible to mutually space apart the positions of the inner open ends 21 of the plurality of tone hole tubes 3 in the height direction of the main tube 11. Thereby, even if the axial lengths of the plurality of tone hole tubes 3 mutually differ, it is possible to mutually approximate the outer open ends 22 of the plurality of tone hole tubes 3 in the height direction of the main tube 11. As a result, it is possible to easily block the outer open ends 22 of the plurality of tone hole tubes 3 with a plurality of fingers. That is, it is possible to easily ensure the operability of the wind instrument 1.

In the wind instrument 1 of the present embodiment, by the meandering direction of the main tube 11 being parallel with the height direction of the main tube 11, it is possible to reduce the interval between the first tone hole tube 3A that is opened and closed by the index finger of the left hand and the thumbhole 14 that is opened and closed by the thumb of the left hand. For this reason, when blocking both the first tone hole tube 3A and the thumbhole 14, it is possible to grip the tube body 2 in a pinching manner with the left hand thumb and index finger. That is, it is possible for the performer to stably grip the wind instrument 1 and so it is possible to achieve an improvement in the operability of the wind instrument 1.

In the wind instrument 1 of the present embodiment, by the reduction in the interval between the outer open ends 22 of the tone hole tubes 3 due to the curving of the main tube 11 and the tone hole tubes 3, it is possible to configure the key mechanism 8 in a compact manner.

Specifically, since it is possible to increase the number of the outer open ends 22 of the tone hole tubes 3 that can be directly blocked by fingers, it is possible to reduce the number of tone hole tubes 3 that are opened and closed using the key mechanism 8. That is, it is possible to reduce the number of operators 41 (keys) of the key mechanism 8. Also, since it is possible to set short the length of the operators 41 of the key mechanism 8, it is also possible to achieve an improvement in reliability of the wind instrument 1.

In addition, according to the wind instrument 1 of the present embodiment, by the main tube 11 meandering in the height direction, the depression portion 15 is formed at a region on the lower side of the main tube 11. By the right hand thumb of the performer being placed at this depression portion 15, the performer can grip the wind instrument 1 in a stable manner. Also, in the state of the right hand thumb being placed at the depression portion 15, since the right hand is stably positioned with respect to the main tube 11, it is also possible to perform a stable opening and closing operation of the tone hole tubes 3 with the performer's fingers excluding the right hand thumb.

Also, according to the wind instrument 1 of the present embodiment, since the tone hole tubes 3 that are curved each have a curved tube portion 23, it is possible to freely and suitably arrange the outer open ends 22 of the tone hole tubes 3 with respect to the inner open ends 21. That is, it is possible to easily ensure the operability of the wind instrument 1.

In the wind instrument 1 of the present embodiment, the main tube 11 meanders only in the height direction, and the plurality of tone hole tubes 3 extend only in the height direction and lengthwise direction from the main tube 11. The plurality of tone hole tubes 3 are arranged in a row in the lengthwise direction of the main tube 11.

For this reason, it is possible to make the shape of the structure including the main tube 11 and the plurality of tone hole tubes 3 a symmetrical shape based on the center of the main tube 11 in the width direction. Thereby, when manufacturing this structure, a pair of separate structures formed in symmetrical shapes, after being molded, may be fixed so as to be bonded together. Accordingly, it is possible to easily manufacture the wind instrument 1.

Second Embodiment

Next, the second embodiment of the present invention will be described referring to FIG. 4. Only some constitutions of the wind instrument of the present embodiment differ from the wind instrument 1 of the first embodiment, with the other constitutions being the same. In the present embodiment, the same reference numerals are given to the same constituent elements as those of the first embodiment, with descriptions thereof being omitted.

Figure 4:
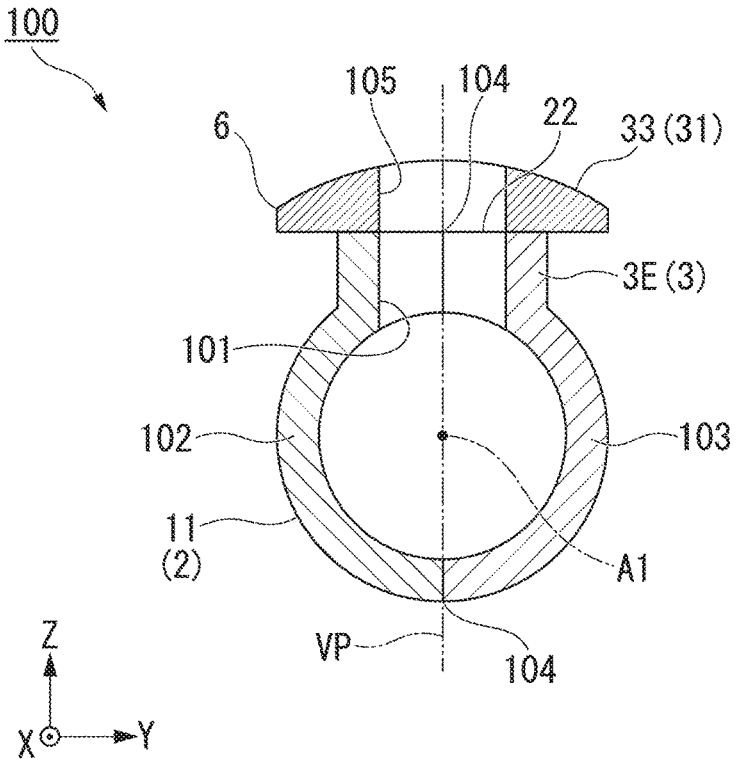
FIG. 4 is a cross-sectional view showing the main portions of the wind instrument according to the second embodiment of the present invention.

As shown in FIG. 4, a wind instrument 100 of the present embodiment is provided with the same wind body 2, tone hole tubes 3 and finger pressing plate 6 as the wind instrument 1 of the first embodiment. Also, in the wind instrument 100 of the present embodiment, the tube body 2 and the tone hole tubes 3 are integrally formed similarly to the first embodiment. However, in the wind instrument 100 of the present embodiment, the finger pressing plate 6 is formed separately from the tube body 2 and the tone hole tubes 3. Hereinbelow, the wind instrument 100 of the present embodiment is described in detail.

In the present embodiment, the main tube 11 of the tube body 2 has a first through hole 101 that constitutes the tone hole of the wind instrument 100. The first through hole 101 penetrates the main tube 11 from the inner side to the outer side.

The tone hole tube 3 is integrally formed at the outer circumference of the main tube 11. The tone hole tube 3 constitutes the first through hole 101 of the main tube 11 and the tone hole of the wind instrument 100.

The structure including the main tube 11 and the tone hole tube 3 is constituted by a pair of separate structures 102, 103 that are separated so as to divide the tone hole of the wind instrument 100 into parts. The boundary 104 of the pair of separate structures 102, 103 is included in the same virtual plane VP together with the axial line A1 of the main tube 11 and the axial line of the tone hole. In the wind instrument 100 of the present embodiment, similarly to the first embodiment, the main tube 11 does not meander in the width direction (Y-axis direction) of the tube body 2. For this reason, the aforementioned virtual plane VP is a plane that is orthogonal to the width direction of the tube body 2.

In the present embodiment, the boundary 104 of the pair of separate structures 102, 103 is positioned in the center of the main tube 11 in the width direction. For this reason, the pair of separate structures 102, 103 are formed in symmetrical shapes based on the center of the main tube 11 in the width direction.

Although not illustrated, the tube body 2 of the present embodiment has an auxiliary tube 12 that extends in the height direction (Z-axis direction) and lengthwise direction (X-axis direction) of the tube body 2 with respect to the main tube 11 and does not extend in the width direction of the tube body 2, similarly to the first embodiment (refer to FIGS. 1, 2). For this reason, in the wind instrument 100 of the present embodiment, the structure including for example the main tube 11, the tone hole tube 3 and auxiliary tube 12 may be constituted by the pair of separate structures 102, 103.

The finger pressing plate 6 has a second through hole 105 that penetrates in the plate thickness direction. The second through hole 105 constitutes the tone hole of the wind instrument 100 together with the first through hole 100 of the main tube 11 and the tone hole tube 3. The finger pressing plate 6 is arranged on the outer circumference of the main tube 11 so as to cover the boundary 104 of the pair of separate structures 102, 103.

The finger pressing plate 6 of the present embodiment is disposed at the outer open end 22 of the tone hole tube 3 so as to cover the boundary 104 of the pair of separate structures 102, 103 that appear at the outer open end 22 of the tone hole tube 3. The finger pressing plate 6 that is disposed in this way extends more to the outer side than the outer open end 22 of the tone hole tube 3 in the radial direction of the tone hole tube 3, similarly to the first embodiment.

The wind instrument 100 of the present embodiment exhibits the same effect as the first embodiment.

Also, in the wind instrument 100 of the present embodiment, the structure including the tube body 2 and the tone hole tube 3 is constituted by the pair of separate structures 102, 103. For this reason, it is possible to individually mold the pair of separate structures 102, 103, and it is possible to easily manufacture the wind instrument 100.

The structure that includes the tube body 2 and the tone hole tube 3 is separated into the pair of separate structures 102, 103 so as to divide the tone holes of the wind instrument 100. For this reason, prior to joining together the pair of separate structures 102, 103, it is possible to easily process the inner surface of the tone hole. For example, at the end portion of the tone hole positioned at the inner side of the main tube 11, it is possible to easily form an undercut structure in which the inner diameter of the tone hole gradually increases heading to the inner side of the main tube 11. The formation of the undercut structure is useful for improving the acoustic performance of the wind instrument 100 such as pitch. That is, according to the wind instrument 100 of the present embodiment, it is also possible to easily secure the acoustic performance of the wind instrument 100.

Also, in the wind instrument 100 of the present embodiment, the boundary 104 of the pair of separate structures 102, 103 is covered by the finger pressing plate 6. For this reason, when the performer plays the wind instrument 100, the fingers of the performer that open and close the tone holes only touch the finger opening surface 33 of the finger pressing plate 6 and make no contact with the boundary 104 of the pair of separate structures 102, 103. As a result, the performer can smoothly play the wind instrument 100. Hereinbelow, this point will be specifically described.

A minute step may appear at the boundary 104 of the pair of separate structures 102, 103. For this reason, when the fingers of the performer touch the step between the pair of separate structures 102, 103, the performer may feel a sense of discomfort or stress. In contrast, in the wind instrument 100 of the present embodiment, since the boundary 104 of the pair of separate structures 102, 103 is covered by the finger-pressing plate 6, the performer can smoothly play the wind instrument 100 without feeling a sense of discomfort or stress.

Figure 5:
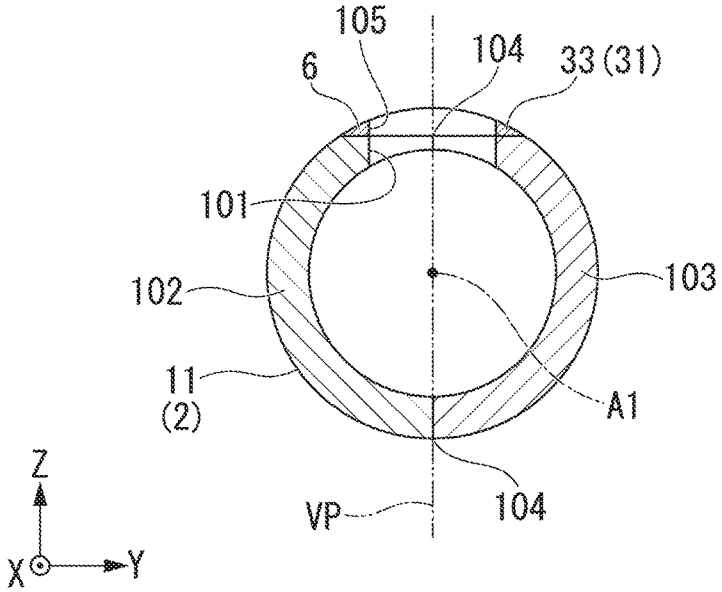
FIG. 5 is a cross-sectional view showing the main portions of the wind instrument according to another embodiment of the present invention.

In the second embodiment, as shown for example in FIG. 5, the wind instrument may be provided with only the tube body 2 and the finger pressing plate 6 without being provided with the tone hole tube 3. In this case, the finger pressing plate 6 is directly disposed on the outer periphery of the main tube 11. Even with such a constitution, the same effect as the second embodiment described above is exhibited.

Although the present invention was described in detail above, the present invention is not limited to the aforementioned embodiments, and various modifications can be made within a scope that does not depart from the gist of the present invention.

Figure 6:
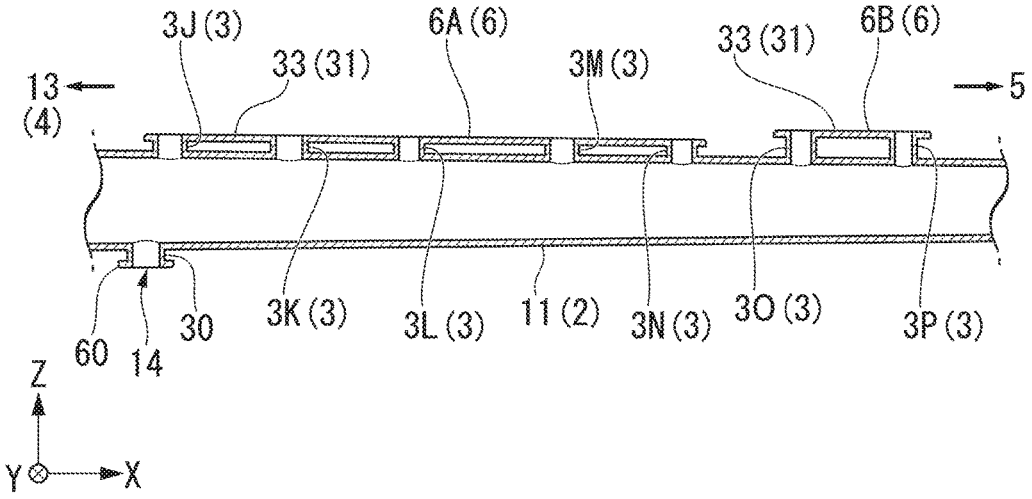
FIG. 6 is a cross-sectional view showing the main portions of the wind instrument according to another embodiment of the present invention.
Figure 7:
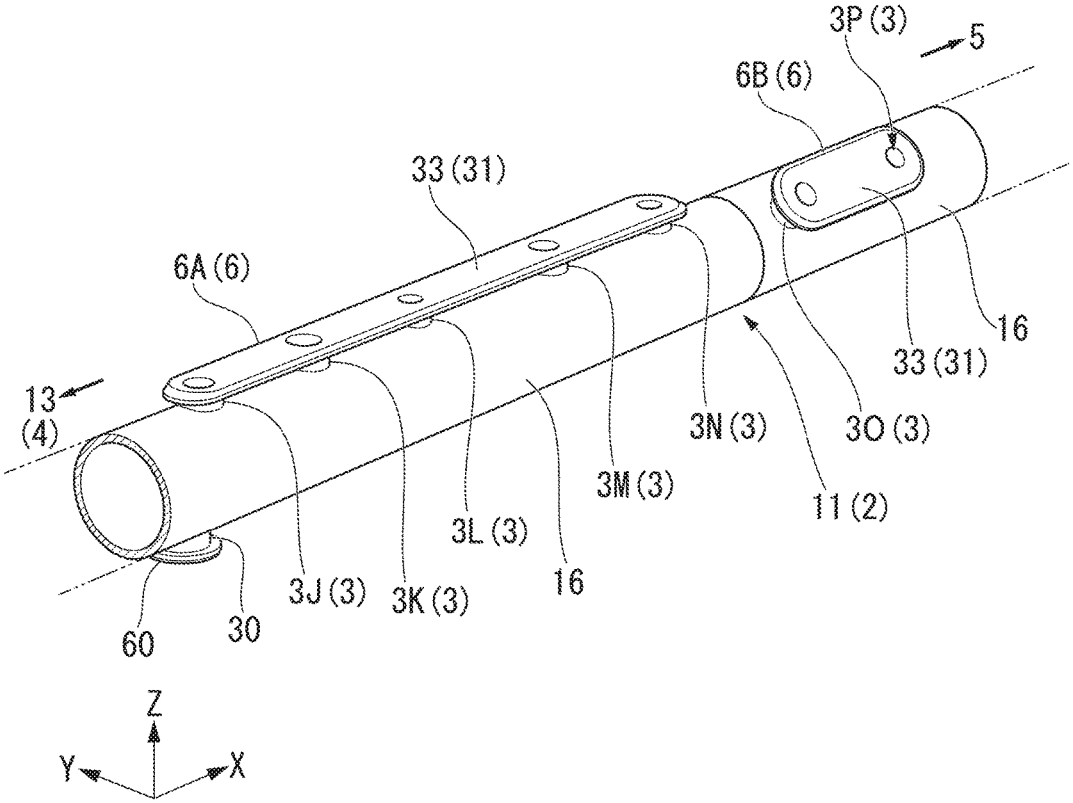
FIG. 7 is a perspective view showing the main portions of the wind instrument according to another embodiment of the present invention.

The wind instrument of the present invention is not limited to one that includes the key mechanism 8, and may be applied to a wind instrument of a type in which all of the tone hole tubes 3 are directly opened and closed by fingers, as shown for example in FIGS. 6 and 7.

In the aforementioned embodiment, the tone hole tube 3 may also have an inclined tube portion in which for example the axial line of the tone hole tube 3 extends straight in a direction inclined with respect to the radial direction of the main tube 11. In this case, the axial line of the tone hole tube 3 should extend in a direction that is inclined with respect to the radial direction of the main tube 11, so that the outer open ends 22 of the plurality of tone hole tubes 3 assume positions corresponding to the fingers that block them. Also, the tone hole tubes 3 may also have for example the inclined tube portion and the curved tube portion 23 similar to the aforementioned embodiment.

In addition, the main tube 11 and the tone hole tube 3 may be neither curved not inclined as shown for example in FIGS. 6 and 7.

The plurality of tone hole tubes 3 are not limited to being arranged in a row in the lengthwise direction of the main tube 11, and may also be positioned mutually shifted in the circumferential direction of the main tube 11 as shown for example in FIG. 7. That is, the inner open ends 21 of the plurality of tone hole tubes 3 may be disposed at for example mutually different positions in the circumferential direction of the main tube 11.

The outer open ends 22 of the plurality of tone hole tubes 3 may be disposed at mutually different positions in the height direction of the main tube 11, as shown for example in FIG. 6. The directions of the outer open ends 22 of the plurality of tone hole tubes 3 may also mutually differ.

The finger opening surface 33 of the finger pressing plate 6 may be formed into a curved surface that inclines upward while for example moving away from the outer open ends 22 of the tone hole tubes 3. In this case, since a dent shape that allows fingers to enter above the outer open ends 22 of the tone hole tubes 3 is formed by the finger opening surface 33 that is formed into a curved surface, it is possible to correctly and easily block the outer open ends 22 of the tone hole tubes 3 with the fingers of the performer.

In addition, the finger opening surface 33 of the finger pressing plate 6 (opening surface 31) may also be a flat surface as shown for example in FIGS. 6 and 7.

The wind instrument of the present invention may also be provided with a plurality of finger pressing plates 6 as shown for example in FIGS. 6 and 7. Two finger pressing plates 6 (6A and 6B) are disposed on the outer periphery of the main tube 11 of the wind instrument illustrated in FIGS. 6 and 7. In the constitution illustrated in FIGS. 6 and 7, the first finger pressing plate 6A is provided for the first to fifth tone hole tubes 3J to 3N counting from the first end portion 13 side of the main tube 11, and the second finger pressing plate 6B is provided for the sixth and seventh tone hole tubes 3O and 3P, but the number of tone hole tubes 3 corresponding to each finger pressing plate 6 may be arbitrary. For example, the first finger pressing plate 6A may be provided for the tone hole tubes 3 that are opened and closed by fingers of the left hand, and the second finger pressing plate 6B may be provided for the tone hole tubes that are opened and closed by the fingers of the right hand. In such a constitution, even when the axial lengths of the tone hole tubes 3 differ as illustrated in FIG. 6, it is possible to form each finger pressing plate 6 with a simple shape (a flat plate shape in FIG. 6).

The finger pressing plate 6 may also for example be provided individually for the plurality of tone hole tubes 3. In this case, while the size of the opening surface 31 of the finger pressing plate 6 at the circumference of the outer open end 22 of each tone hole tube 3 may be arbitrary, it should be set to an extent ensuring that, when for example a finger of the performer is placed on the opening surface 31, the finger does not touch the edge of the distal end of the finger pressing plate 6 in the extending direction.

When the wind instrument is provided with a plurality of finger pressing plates 6, as shown for example in FIG. 7, the main tube 11 may be provided with two or more tube body portions 16 that are connected in a mutually rotatable manner, with each tube body portion 16 being provided with the tone hole tubes 3 and the finger pressing plate 6.

In this constitution, by mutually rotating the two tube body portions 16, it is possible to relatively change the positions (directions) of the outer open ends 22 of the tone hole tubes 3 disposed in the two tube body portions 16 in the circumferential direction of the main tube 11. Thereby, it is possible to suitably adjust the positions of the outer open ends 22 of the plurality of tone hole tubes 3 in accordance with the size and length of the fingers of the performer.

The thumbhole 14 may be constituted by a tone hole tube 30 extending from the outer circumference of the main tube 11 similarly to the pitch tone holes, as shown for example in FIGS. 6 and 7. Also, a finger pressing plate 60 that, in the radial direction of the tone hole tube 30, extends from the outer open end of the tone hole tube 30 to the outside of the tone hole tube 30 may also be provided, similarly to the aforementioned embodiments.

The tube body 2 of the wind instrument may be arbitrarily constituted. That is, the tube body 2 may be constituted by only the main tube 11 without being provided with for example the auxiliary tube 12. In this case, the tube body 2 (main tube 11) is not limited to a cylindrical shape, and may for example be formed in for example a conical tube shape.

The tube body 2 (main tube 11) of the wind instrument illustrated in FIG. 6 is formed in a conical tube shape in which the inner diameter dimension becomes smaller heading from the mouthpiece 4 side to the bell 5 side.

REFERENCE SYMBOLS

1, 2: Wind instrument
2: Tube body
3, 3A, 3B, 3C, 3D, 3E, 3F, 3G, 3H, 3I, 3J, 3K, 3L, 3M, 3N, 3O, 3P, 30: Tone hole tube
4: Mouthpiece
5: Bell
6, 6A, 6B, 60: Finger pressing plate
8: Key mechanism
11: Main tube
12: Auxiliary tube
16, 16A, 16B Tube body portion
21: Inner open end
22: Outer open end
31: Opening surface
101: First through hole
102, 103: Separate structure
104: Boundary
105: Second through hole

The invention claimed is:

1. A wind instrument comprising:
a tube body having at least a first opening;
a tone hole tube having:
a region extending in a height direction of the tube body from an outer periphery of the tube body;
an inner open end surrounding the first opening; and
an outer open end spaced from the outer periphery of the tube body and opening to the outside of the tube body; and
a finger pressing plate disposed spaced apart from the outer periphery of the tube body and extending from the outer open end of the tone hole tube in a radial direction of the tone hole tube.

2. The wind instrument according to claim 1, further comprising:

a plurality of ones of the tone hole tube, wherein the finger pressing plate is provided common to the plurality of tone hole tubes.

3. The wind instrument according to claim 2, wherein the finger pressing plate has a surface, on the side to which the outer open end opens, that is curved.

4. The wind instrument according to claim 2, wherein:

the tube body has at least two tube body portions that are connected in a mutually rotatable manner, and the tone hole tube and the finger pressing plate are disposed in each tube body portion.

5. The wind instrument according to claim 1, wherein the finger pressing plate has a surface, on the side to which the outer open end opens, that is curved.

6. The wind instrument according to claim 5, wherein:

the tube body has at least two tube body portions that are connected in a mutually rotatable manner, and the tone hole tube and the finger pressing plate are disposed in each tube body portion.

7. The wind instrument according to claim 1, wherein:

the tube body has at least two tube body portions that are connected in a mutually rotatable manner, and the tone hole tube and the finger pressing plate are disposed in each tube body portion.

8. A wind instrument comprising:

a tube body;

a tone hole tube having:

a first through hole; and a region extending in a height direction of the tube body; and a finger pressing plate disposed spaced apart from an outer periphery of the tube body and having a second through hole that constitutes, together with the first through hole, a tone hole, wherein the tube body and the tone hole tube comprise a joined pair of separate structures that divide the tone hole, and wherein the finger pressing plate is disposed over and covers the boundary of the pair of separate structures.

* * * * *